United States Patent [19]

Drewett et al.

[11] Patent Number: 4,478,536

[45] Date of Patent: Oct. 23, 1984

[54] ADJUSTABLE LENGTH SHOCK ABSORBING ARRANGEMENT FOR A MARINE STRUCTURE

[75] Inventors: Glen E. Drewett, P.O. Box 15, Negreet, La. 71460; Kenneth W. Guynes, Houston, Tex.

[73] Assignee: Glen E. Drewett, Negreet, La.

[21] Appl. No.: 486,184

[22] Filed: Apr. 18, 1983

[51] Int. Cl.[3] ..... E02B 3/22

[52] U.S. Cl. ..... 405/213; 114/220

[58] Field of Search ..... 405/212, 213, 214, 215; 114/219, 220

[56] References Cited

U.S. PATENT DOCUMENTS

| | | | |
|---|---|---|---|
| 4,273,473 | 6/1981 | Thomerson et al. | 405/212 |
| 4,293,241 | 10/1981 | Helveston et al. | 405/213 |
| 4,338,046 | 7/1982 | Thomerson | 405/212 |
| 4,408,931 | 10/1983 | Leblanc et al. | 405/213 |
| 4,411,556 | 10/1983 | Leblanc et al. | 405/213 |

*Primary Examiner*—David H. Corbin
*Attorney, Agent, or Firm*—Jack W. Hayden

[57] ABSTRACT

Annular, hollow upper and lower members are secured to an upwardly extending supporting leg of an offshore structure to project therefrom in generally the same plane. Each of the members includes a cylinder with the upper and lower cylinders being axially aligned and projecting from an end of each of the members; each cylinder also has a smaller diameter than its respective member to provide an annular space therebetween and each cylinder has an end portion within its respective member. Yieldable material is molded in the annular space between each member and its cylinder and is provided with longitudinal recesses therein to accommodate movement of the cylinder relative to its respective member. A longitudinal stem is provided for securing to and extending between the upper and lower cylinders with a support thereon for supporting a cylindrical bumper on the stem for rotation relative thereto. Second yieldable material is molded between the cylindrical bumper and the stem. The cylindrical bumper comprises three sections, and the second yieldable material includes an upper spider molded within an upper section of the cylindrical bumper and a lower spider molded within a lower cylindrical section of the bumper which is longitudinally spaced from the upper bumper section by a central hollow bumper section secured at its upper end to the upper bumper section and at its lower end to the lower bumper section, whereby the length of the cylindrical central section can be varied as desired by varying the length of the central bumper section.

3 Claims, 2 Drawing Figures

ADJUSTABLE LENGTH SHOCK ABSORBING ARRANGEMENT FOR A MARINE STRUCTURE

SUMMARY OF THE INVENTION

The closest prior art with which Applicants have any knowledge is United States Letters Pat. No. 3,995,437.

Various shock absorbing arrangements have been proposed and are in use with offshore structures. In some instances an effort is made to designate certain portions of marine structures for docking stations for certain types or sizes of craft or vessel, while other portions of the marine structure may be designated for receiving either larger or smaller vessel or craft. However, as a practical matter, it is not always generally possible to regulate where a vessel or what size vessel docks adjacent a structure in offshore operations, particularly in the exploration for oil and gas. Additionally, the wave and wind action acting on a vessel adjacent a structure may vary during the time that the vessel is docked, or during docking operations or when the vessel is leaving the marine structure. It is not unusual for the shock contact between a vessel and marine structure to be rather severe, and various types of arrangements have been heretofore provided and are in use in an endeavor to accommodate all of the varying conditions which might be encountered at sea when docking a craft or vessel adjacent an offshore marine structure.

It is also desirable to provide a shock absorbing arrangement which rotates when contacted by a vessel to assist in reducing the shock and to aid in distributing the load of the shock over a larger surface of the bumper shock arrangement as the vessel remains in contact therewith and moves alongside the marine structure. It is not uncommon for vessels to use the shock arrangement to tie the vessel lines therewith, and this places the shock arrangements under tension shock loading as the vessel moves back and forth due to wave and wind action.

Therefore, an object of the present invention is to provide a shock absorbing arrangement for a marine structure which can be readily assembled as may be desired.

Yet a further object of the present invention is to provide a shock arrangement for a marine structure which can take substantial shock loads and accommodate substantial relative movement of the shock absorbing arrangement in both compression and tension loading.

Other objects and advantages of the present invention will become more readily apparent from a consideration of the following drawings and description.

Description of the Preferred Embodiment

Figure 1:
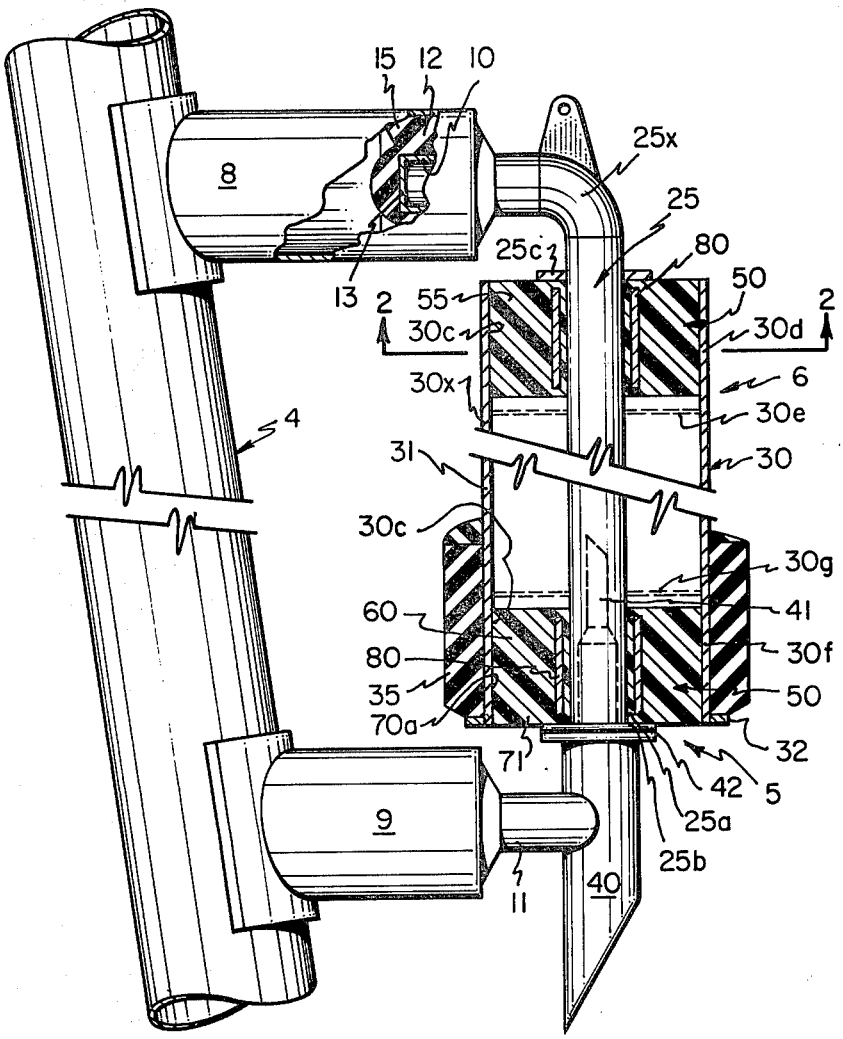
FIG. 1 is a partial elevational view of a structure leg of an offshore or marine structure with the bumper guard and shock absorbing arrangement of the present invention positioned thereon.

Attention is first directed to FIG. 1 of the drawings wherein a portion of a structure leg of an offshore marine structure is represented generally by the numeral 4. It can be appreciated that the lower end of such leg is positioned in the earth in the water covered area with the upper leg end terminating above the water covered area to serve as a suitable support for a deck or platform in the water covered area. It can be further appreciated that a plurality of such legs is provided to accomplish the desired support of the structure above the water covered area.

The bumper guard and shock absorbing arrangement of the present invention is referred to generally by the numeral 6.

It includes annular, hollow upper and lower cylindrical members 8 and 9 which may be secured by any suitable means at one end to the upwardly extending leg 4 in a desired spaced relation as illustrated. The cylindrical members 8 and 9 project from the leg 4 in the same direction and in generally the same plane. Each of the members 8 and 9 includes cylinder means 10 and 11 which are axially aligned with their respective cylindrical member 8 and 9, and each projects from the end of its respective cylindrical member that is spaced from the structure leg 4. The cylinder means 10 and 11 each has a smaller diameter than its respective cylindrical member 8 and 9 to provide an annular space 12 therebetween. Each of the cylinder means 8 and 9 is also provided with a closed end 13 positioned within its respective cylindrical member 8 or 9.

Yieldable elastomer means 15 are molded in the annular space 12 and extend around the closed end 13 to encase each of the cylinders 10 and 11 and to accommodate longitudinal movement as well as radial movement relative to its respective member 8 or 9.

A longitudinally extending stem 25 is provided for securing to and extending between the upper and lower cylinder means 10 and 11 as shown in FIG. 1 of the drawings. The stem means 25 includes support means 5 for the cylindrical bumper means referred to generally by the numeral 30 whereby relative rotation between the bumper 30 and the stem 25 may occur. When a vessel engages or impacts against or remains in contact with bumper 30 as it moves when alongside the marine structure, the bumper 30 may rotate on stem 25, thus presenting a different surface area thereof for contact with the vessel.

The cylindrical bumper 30 is shown as including a rigid cylindrical member 31 of desired longitudinal extent as will be described, with the lower end of the rigid cylindrical member being provided with a cylindrical stop means 32 for extending thereabout to provide a seat or support for the annular elastomer bumper 35. In some instances, the elastomer bumper 35 may be eliminated so that the vessel contacts directly the cylindrical metal surface of the rigid cylindrical member 31.

The support means 5 for the cylindrical bumper means 30 includes a lower stabbing guide 40 which is secured by any suitable means such as welding or the like to the outermost end of the lower cylinder means 11 and projects upwardly therefrom as shown. It includes a portion 41 of reduced size relative to lower stabbing guide 40 to act as a guide in guiding the lower end of hollow stem 25 into seating arrangement on the lower stop means 42 formed on lower stabbing guide 40 at its juncture with the smaller portion 41. Stop 42 may consist of an annular ring secured by welding or any suitable means on the stabbing guide 40 as shown. The portion 41 of the stabbing guide 40 guides the stem 25 onto the seat ring 42 as the stem is telescopically received over the portion 41 of the stabbing guide 40. The lower end **25*a* of the stem 25 is provided with an annular stop or seat 25b for abutting and resting on the annular stop 42** as shown in the drawings.

Upper stop means 25c on the stem 25 are provided for limiting upward movement of the bumper 30 arrangement and to prevent the cylindrical bumper means from moving off the stabbing guide 40 when a vessel contacts the arrangement of the present invention. The stop means 25b, 42 and 25c are preferably in the form of annular platelike members to provide for more surface contact. For example, the lower stop means 42 and the stop 25b engage each other and cooperate to accommodate rotation of the cylindrical bumper 30 as hereinabove described. The surface 25c engages the surface of the upper spider 55 in bumper means 30 to assist in retaining the bumper means 30 in position and to accommodate rotation during use of the present invention. The upper end of the stem 25 is connected by the elbow 25x to the cylinder means 10 as shown in the drawings.

The cylindrical bumper means 30 includes yieldable means referred to generally at 50 between the cylindrical bumper means 30 and stem means 25. The yieldable means 50 specifically includes an upper spider 55 of yieldable substance such as a urethane or an elastomer and a lower spider 60 of similar yieldable substance. Each spider 55 and 60 includes an outer annular surface or body portion which is molded adjacent the uppermost and lowermost inner surface portion 30c of the cylindrical bumper 30.

Figure 2:
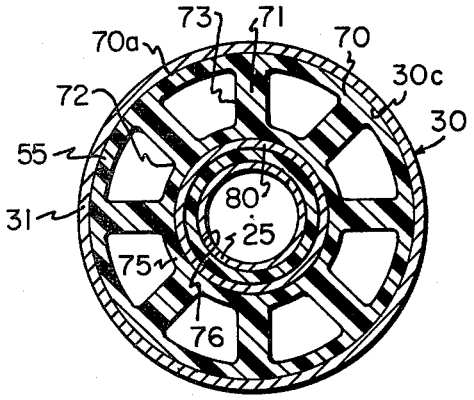
FIG. 2 is a sectional view on the line 2—2 of FIG. 1 to better illustrate details of the present invention.

Each spider includes an outer annular body portion 70, whose outer surface 70a is molded to the adjacent surfaces 30c. Extending inwardly from the outer annular body portion 70 is a plurality of radial legs 71 which is spaced circumferentially as better seen in FIG. 2 of the drawings to form longitudinal openings 73 extending through each of the spiders 55 and 60. The inner ends 72 of the legs 71 terminate in an annular central body portion 75 which has a central opening 76 therein for receiving the stem 25 therethrough. A rigid annular, longitudinally extending reinforcing sleeve 80 is embedded in and extends longitudinally of said central body 75 as shown in the drawings. Thus, the central body of each spider contacts the stem and acts as a bearing surface during relative movement between stem 25 and bumper means 30.

More specifically, it will be noted that the upper spider 55 is molded to an upper section 30d and the spider 55 of molded yieldable material, in the preferred form, extends substantially the extent of the upper section 30d of the cylindrical bumper 30. The upper section is shown as terminating at 30e.

Similarly, the lower spider 60 is molded in the lower section 30f and extends substantially throughout the longitudinal extent thereof in the preferred form, with the lower section 30f of the cylindrical bumper 30 terminating at its upper end as illustrated at 30g. Extending between the upper bumper section 30d and lower bumper section 30f of the cylindrical bumper 30 is a cylindrical hollow section 30x with its upper end connected to the end 30e of the upper section, with the lower end of 30x connected to the upper end 30g of the lower bumper section 30f by any suitable means such as welding or the like.

This arrangement enables a bumper guard and shock arrangement of any desired or suitable longitudinal extent to be provided. In some instances, the customer may desire to provide its own central hollow section 30x of whatever longitudinal extent and merely by securing the first or upper section 30d and lower or second section 30f to each end thereof by welding or the like, a bumper and shock absorbing arrangement of desired longitudinal extent may be provided.

Of equal importance is the degree of deflection obtainable by the present invention.

More specifically, the yieldable substance forming the spider arrangement when employed with a cylindrical bumper means of 32' diameter with 1" wall thickness can be formed in each of the sections 30c and 30d so as to accommodate 5" deflection in any direction. The shock cells formed by the arrangements of the upper member 8 and cylinder means 10 as well as the lower member 9 and its cylinder means 11 accommodates approximately 8" of deflection for a total movement of 13" either in compression or tension loading. Quite often, a vessel is tied up to the shock absorbing arrangements provided on marine structures, and a wave action under some circumstances can be quite severe so that the impact loading both in compression and tension to the shock absorbing arrangements of marine structures in turn can be quite substantial. However, by providing the yieldable mass in the manner as described and disclosed herein, substantial relative movement between the structure leg and the bumper guard and shock arrangement of the present invention is accomplished in response to either compression or tension loading.

Furthermore, since the cylindrical bumper means 30 is relatively rotatable on the stem 25, movement of the vessel when tied up next to the structure adjacent the bumper guard and shock absorber arrangement of the present invention is readily accommodated. Similarly, when the vessel is docking adjacent a structure on which the present invention is employed, initial contact and contact of the vessel with the bumper arrangement of the present invention effects rotation thereof and thus inhibits damage to the shock absorbing arrangement.

The foregoing disclosure and description of the invention are illustrative and explanatory thereof, and various changes in the size, shape and materials as well as in the details of the illustrated construction may be made without departing from the spirit of the invention.

What is claimed is:

1. A shock absorbing arrangement for marine structures to absorb shock compression and tension comprising:

(a) annular, hollow upper and lower members for securing to an upwardly extending supporting leg of an offshore structure to project therefrom in generally the same plane, each of said members including:

(1) cylinder means axially aligned and projecting from an end of each of said members;

(2) said cylinder means having a smaller diameter than its respective member to provide an annular space therebetween and having a closed end positioned within its respective member;

(3) first yieldable means molded in the annular space to encase said cylinder means to accommodate movement of said cylinder means relative to its respective member;

b. stem means for securing to and extending between said upper and lower cylinder means;

c. cylindrical bumper means;

d. support means supporting said cylindrical bumper means on said stem means for rotation relative thereto; and e. yieldable means between said cylindrical bumper means and stem means, said yieldable means including an upper spider of yieldable substance and a lower spider of yieldable substance each having an outer annular surface molded adjacent the upper and lower inner surface of said cylindrical bumper with a plurality of legs radiating inwardly in spaced relation to form openings therebetween through each spider, the inner ends of the legs terminating in an annular, central body of yieldable material having a central opening for receiving said stem means therethrough and a rigid, annular reinforcing embedded in and extending longitudinally of said central body; and wherein said cylindrical bumper means is defined by an upper section receiving said upper spider, a lower section receiving said lower spider and a central hollow section between said upper section and said lower section.

2. The arrangement of claim 1 wherein said support means includes:

a. a lower stabbing guide secured to said cylinder means projecting from said lower member, said stabbing guide projecting upwardly therefrom for telescopically receiving said stem means;

b. lower stop means secured to said stabbing guide;

c. lower stop means secured to said stem means for abutting said stop means on said stabbing guide means when said stem means is telescoped on said stabbing guide means; and d. upper stop means for limiting upward movement of said cylindrical bumper means.

3. The arrangement of claim 1 including cylindrical stop means extending around said lower section adjacent its lower end and an annular elastomer member extending longitudinally and supported on said cylindrical stop means.

* * * * *